US007346183B2

(12) United States Patent
Ohara

(10) Patent No.: US 7,346,183 B2
(45) Date of Patent: Mar. 18, 2008

(54) SPIDER WITH LEAD WIRES SANDWICHED

(76) Inventor: Hiroshi Ohara, No. 70, Lane 533, Chung-Feng Road, Wu-Lin Village, Lung-Tan Country, Tao-Yuan Hsien (TW)

( * ) Notice: Subject to any disclaimer, the term of this patent is extended or adjusted under 35 U.S.C. 154(b) by 513 days.

(21) Appl. No.: 11/038,918

(22) Filed: Jan. 19, 2005

(65) Prior Publication Data

US 2006/0159300 A1 Jul. 20, 2006

(51) Int. Cl.
*H04R 1/00* (2006.01)

(52) U.S. Cl. ..... 381/404; 381/396

(58) Field of Classification Search ..... 381/396, 381/404

See application file for complete search history.

(56) References Cited

U.S. PATENT DOCUMENTS 2,526,836 A * 10/1950 Willson ..... 381/404
6,269,167 B1 * 7/2001 Mango et al. ..... 381/404

* cited by examiner

*Primary Examiner*—Brian Ensey

(57) ABSTRACT

An annular spider with lead wires sandwiched is provided. The improved structure of the spider allows the lead wires to be sandwiched in between two surface linings. The annular spider that serves to have the voice coil held in concentric position is formed by a negative shaped press mould with two halves, where each half has at least one half-circle slot on the mould surface, so that at least one tunnel is formed when two complementary slots on opposite mould halves are combined, through which the lead wire is fixed between two surface linings. The complementary slots of the two mould halves can prevent damage or deformation to the lead wires in the spider forming process.

2 Claims, 7 Drawing Sheets

SPIDER WITH LEAD WIRES SANDWICHED

BACKGROUND OF THE INVENTION

1. Field of the Invention

The present invention relates to an annular spider (damper) with lead wires sandwiched, and in particular to an improved spider structure with lead wires sandwiched in between two surface linings, using a specially designed press mould without causing damage or deformation to the lead wires in the press forming.

2. The Related Art

Conventional moving coil speakers include the following components: a speaker driver, a diaphragm, and a suspension system. The speaker driver is composed of an electromagnet, pole pieces, pole plates, an air gap, and a voice coil unit. The diaphragm or speaker cone is the actual component that is responsible for converting the electrical signals into audible sound. The suspension system is composed of an annular spider and an edge support, where the spider is responsible for guiding the motion of the speaker cone in a longitudinal direction. The speaker driver, speaker cone and suspension system are housed in a cone housing.

The voice coil is connected by lead wire to a terminal that is disposed on the outer peripheral wall of the cone housing. When electrical signals are passed through the terminal and the lead wire to the voice coil, a magnetic field is created in response to the input signal, which is perpendicular to the line of force of the electromagnet, so the voice coil will cause the speaker cone to travel through the air gap in the longitudinal orientation. The movement of the speaker cone displaces the air in the vicinity of the cone, and creates sound waves having an amplitude and frequency to match the electrical signals. In this manner the desired audible sound reproduction is achieved.

In the conventional speaker shown in FIG. 1, the terminal B is disposed on the outer peripheral wall of the cone housing D; the voice coil C is mounted between the pole plate and the pole piece in the center. The lead wires 2 are connected across the annular spider A to reach the voice coil C as shown in FIG. 2, wherein the lead wires 2 are constantly being stretched whenever the voice coil and the speaker cone travel downward, so the wire material will experience material fatigue over an extended period, which will cause the wire to break off eventually.

One possible solution is to have the lead wires 2 buried in the spider 1 when the spider 1 is press formed as shown in FIG. 3, and only have the two ends exposed outside the inner rim and outer rim. However, in the press forming of the spider, the lead wires 2 composing of two sheets of fabric materials Al, A2 could be damaged or deformed when the two mould halves are pressed together. If the result is partially deformed wires, the quality of sound reproduction of the loud speaker system could be affected.

SUMMARY OF THE INVENTION

The primary objective of the present invention is to provide an improved spider structure with lead wires sandwiched in between two surface linings, using a negatively shaped press mould without causing damage or deformation to the lead wires in the press forming.

In accordance with the present invention, there are two methods to bury the lead wires in the spider structure. In the first method, one sheet of surface lining is first placed on the lower negatively shaped mould surface, where the two mould halves each have half-circle slots, arranged radially on the mould surface to allow the lead wires to be fitted into the slots on the lower mould half, and then another sheet of surface lining is laid over the first sheet of surface lining covering the lead wires, and then the two mould halves are combined to thermal press the two lining sheets together, so that the two surface linings are bonded together to form a wavy spider structure with lead wires sandwiched in between the two surface linings.

The second method is to first weave the lead wires into the lining fabric, and then to have the lining with the lead wires placed on the lower negatively shaped mould surface, where the two mould halves each have half-circle slots, arranged radially, on the mould surface to allow the lead wires to be aligned with the slots on the upper and lower mould halves, and then to use the two mould halves to thermo press the fabric lining, so as to form a wavy spider structure with lead wires sandwiched in the fabric lining.

Since each mould half has the positions of slots on the mould surface to match the lead wires, so when the two mould halves are combined, the lead wires between the two surface linings are fitted into complimentary slots. This can prevent the press mould from damaging or causing deformation to the lead wires in the press forming process. Therefore, the lead wires can be more durable and the quality of sound reproduction of the speaker will be improved.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
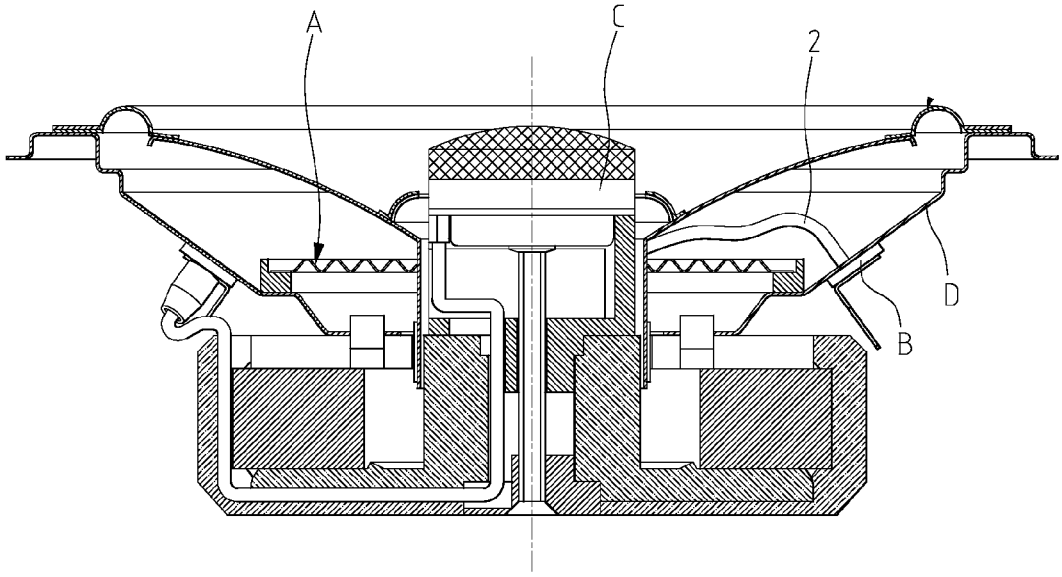
FIG. 1 ( Prior Art )
FIG. 1 is a split view of the structure of a conventional loud speaker.
Figure 2:
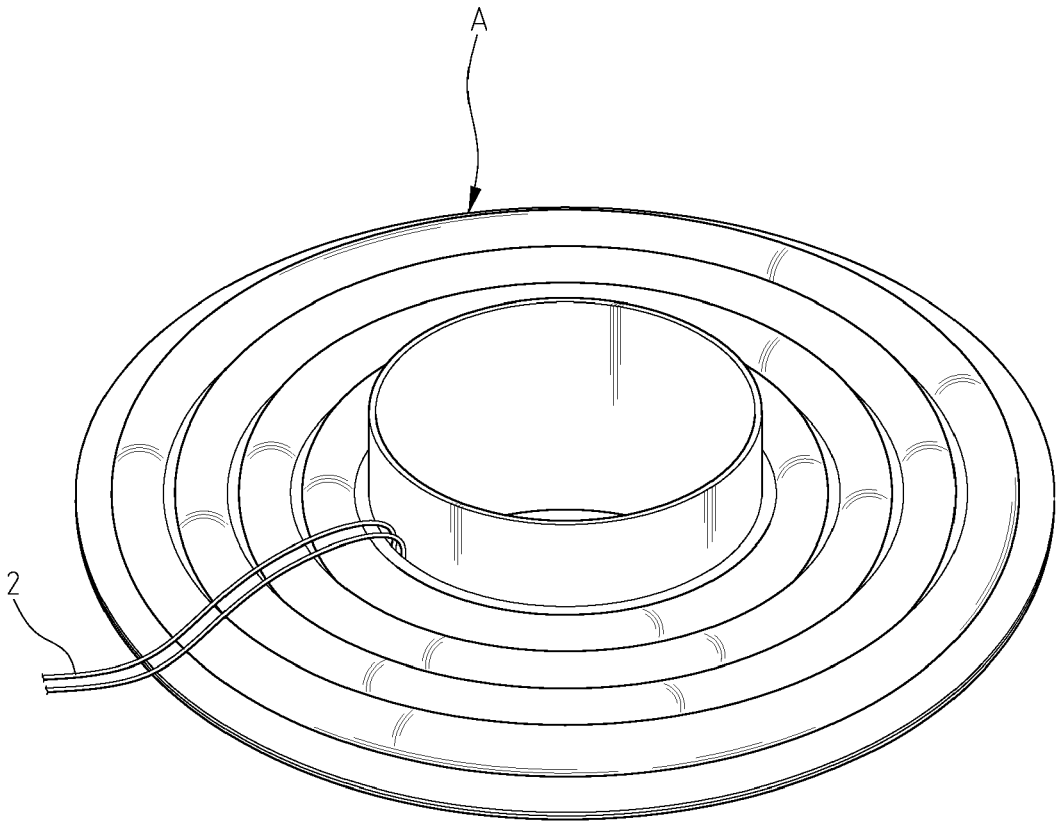
FIG. 2 ( Prior Art )
FIG. 2 is a schematic diagram of the conventional spider with lead wires exposed.
Figure 3:
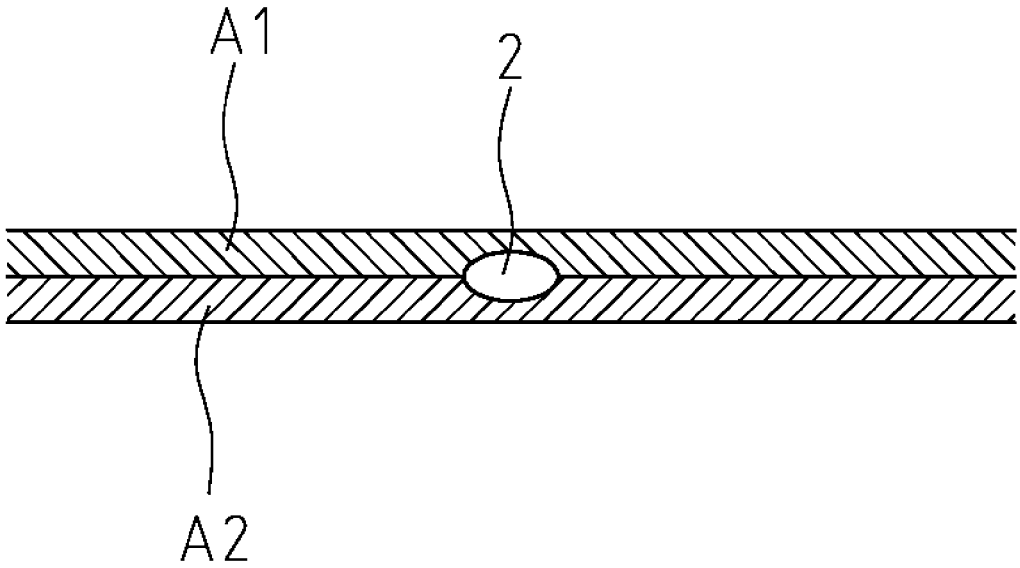
FIG. 3 ( Prior Art )
FIG. 3 is a sectional view of the internal structure of an annular spider with lead wire sandwiched between two surface linings.
Figure 4:
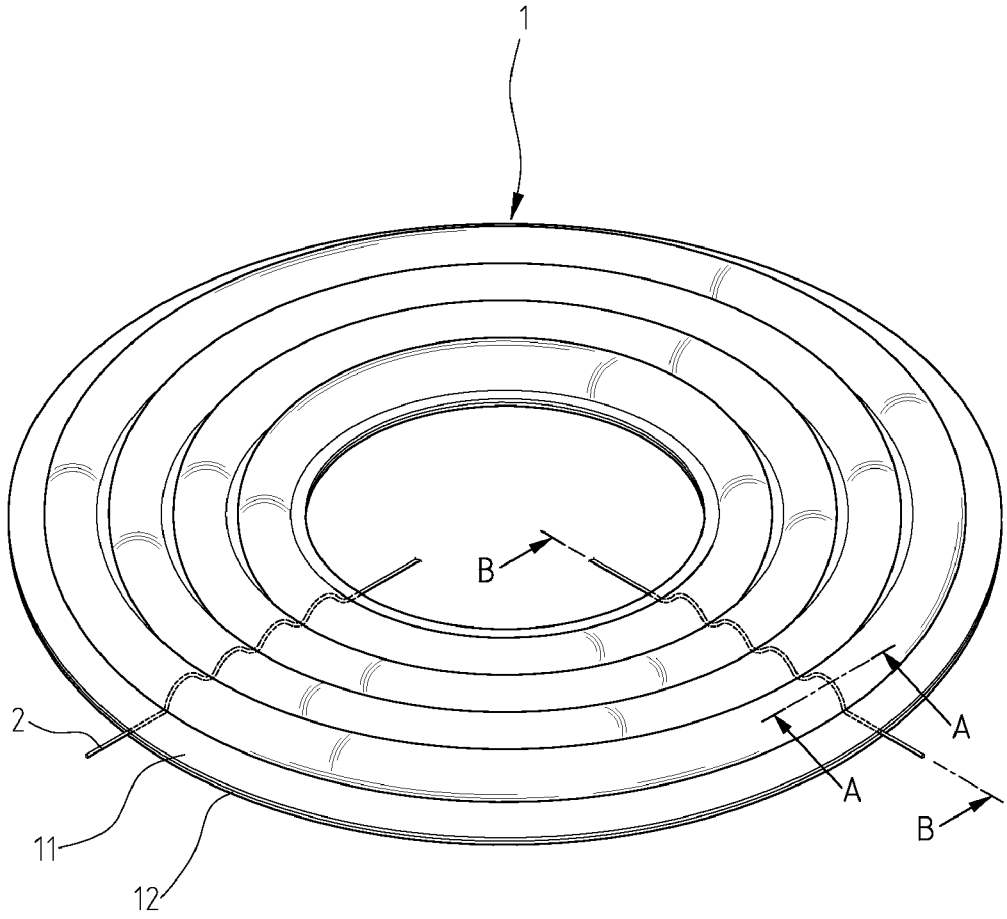
FIG. 4 is a schematic diagram of the spider with lead wire sandwiched in accordance with the present invention.
Figure 5:
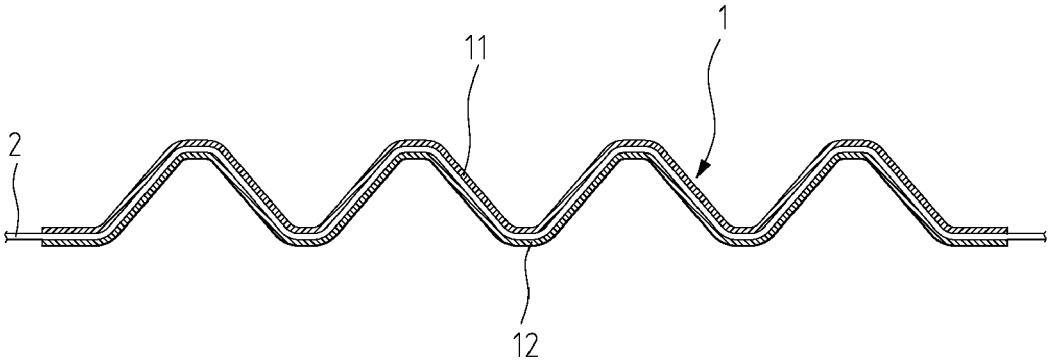
FIG. 5 is a sectional view of the spider taken along line B-B of FIG. 4.
Figure 6:
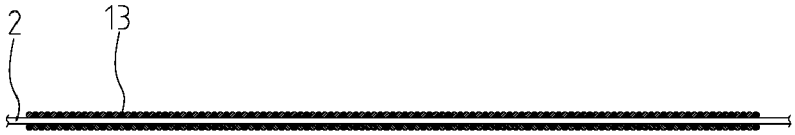
FIG. 6 is a sectional view of a fabric lining that has the lead wires weaved into the material.

The first embodiment of the present invention is an improved spider structure with sandwiched lead-wires as shown in FIG. 4. From the sectional view of the spider structure shown in FIG. 5, taken along line B-B of FIG. 4, at least one lead wire 2 is sandwiched by a first surface lining 11 on the upper side and a second surface lining 12 on the lower side to form an annular spider 1. The spider 1 may have one, two or three lead wires 2 sandwiched in between the two surface linings 11, 12 and arranged radially, only having the two ends of the lead wires 2 exposed outside the inner rim and outer rim.

Figure 8:
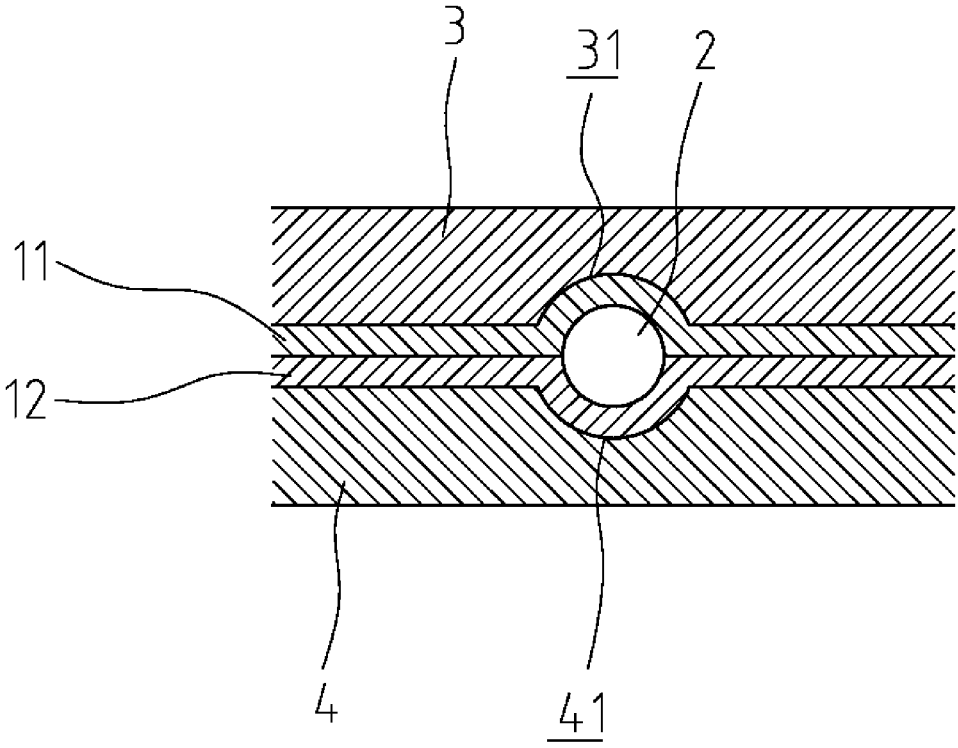
FIG. 8 is a sectional view of the spider structure taken along line A-A of FIG. 4, showing the tunnel and the surface linings in between the two complimentary mould halves.

Again referring to FIG. 5, the annular spider 1 is composed of a first surface lining 11, a second surface lining 12, and at least one lead wire 2, where the surface lining can be a sheet of cloth or other fabric material, which is pre-treated with copolymerized elastomer and then dried. The upper and lower negatively shaped mould halves 3, 4 respectively have multiple first and second slots 31, 41 on the mould surfaces as shown in FIG. 8. The positions of the first slots 31 and second slots 41 shall be aligned, and the slots are preferably in half-circle shape. When the two mould halves 3, 4 are combined, multiple tunnels are formed to hold the lead wires passing through interspaces between two bonded surface linings 11, 12.

In accordance with the first embodiment, before the spider is press formed, the second or lower surface lining 12 is placed on the lower or second negatively shaped mould surface 4, and then multiple lead wires 2 are placed on the lower surface lining 12 and lined up with the slots 41 on the lower mould half 4, and then the first or upper surface lining 11 is laid over the second lining 12 covering the lead wires 2, and then the two mould halves 3, 4 are combined and heat is applied, so that the two linings 11, 12 are bonded together to form a wavy spider 1 with sandwiched lead wires 2, only having the two ends of the lead wires 2 exposed outside the inner rim and outer rim.

In accordance with the second embodiment, before the spider is press formed, the lead wires 2 are first weaved into the lining fabric 13, then the lining fabric 13 is placed on the surface of the lower mould half 4, and then the two mould halves 3, 4 are combined and heat is applied, so that the lining 13 and the lead wires 2 are pressed to form a wavy spider 1 with the lead wires sandwiched in, where the two mould halves 3, 4 have half-circle slots 31, 41 respectively, arranged radially on the mould surfaces to allow the lead wires 2 to be aligned with the slots 31, 41, when the upper and lower mould halves 3, 4 are combined. The annular spider structure only has the two ends of the lead wires exposed outside the inner rim and outer rim, which are used for electrical connections.

Figure 7:
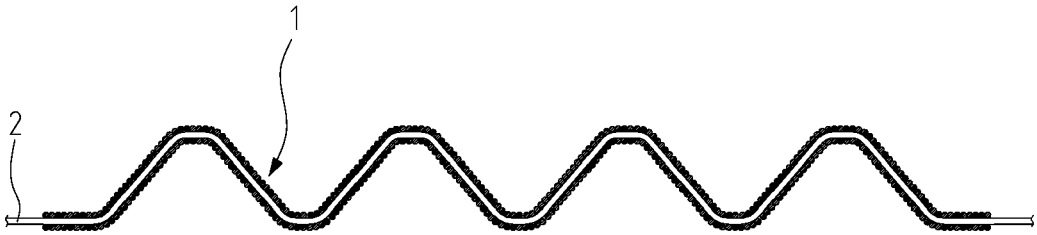
FIG. 7 is a sectional view of the spider structure using the fabric lining weaved in lead wires.

Since the mould halves 3, 4 have the positions of slots 31, 41 on the mould surfaces to match the lead wires 2, when the two mould halves 31, 41 are combined as shown in FIG. 7, the lead wires 2 are fitted into the complimentary slots 31, 41 in between the two surface linings 11, 12. This can prevent the press mould from damaging or causing deformation to the lead wires 2 in the press forming process. The lead wires 2 only have the two ends exposed outside the inner rim and outer rim of the annular spider 1, so the lead wires 2 will be more durable and the workmanship of the spider 1 will improve the quality of sound reproduction of the loud speaker.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A spider, comprising:

an upper surface lining which is a sheet of cloth or other fabric material formed with multiple upper ribs each having a half circle shape;

a lower surface lining which is a sheet of cloth or other fabric material formed with multiple lower ribs each having a half circle shape; and multiple tunnels formed radially by bonding the upper and lower surface linings together with the upper and lower ribs aligned;

wherein multiple lead wires respectively pass through the tunnels from an inner rim to an outer rim of the bonded surface linings.

2. The spider as claimed in claim 1, wherein the spider is press formed using a negative shaped mould with two halves each having multiple half-circle slots on the surface of the mould so that multiple tunnels are created and arranged radially when complementary slots on the two mould halves are combined.

* * * * *